United States Patent [19]

Asplund

[11] 4,275,852

[45] Jun. 30, 1981

[54] APPARATUS FOR CONTROLLING THE REFINING OF FIBROUS PULP GRIST IN A DRUM REFINER

[76] Inventor: Arne J. A. Asplund, Tykovagen 20, 181 61 Lidingo 3, Sweden

[21] Appl. No.: 67,929

[22] Filed: Aug. 20, 1979

[51] Int. Cl.[3] ..... B02C 18/18

[52] U.S. Cl. ..... 241/259.2; 241/37

[58] Field of Search ..... 241/27, 28, 30, 259.1, 241/259.2, 261, 260, 244, 188 R, 191, 195, 32, 37

[56] References Cited

U.S. PATENT DOCUMENTS

| | | | |
|---|---|---|---|
| 1,951,519 | 3/1934 | Milne | 241/259.2 |
| 3,806,050 | 4/1974 | Cumpston, Jr. | 241/260 |

*Primary Examiner*—Mark Rosenbaum

*Attorney, Agent, or Firm*—Eric Y. Munson

[57] ABSTRACT

Apparatus for controlling the refining of fibrous lignocellulosic pulp in a drum refiner in which the pulp stock, or grist, is conveyed into a cylindrical stationary drum and propelled therein in a linear direction in a pulsating fashion by a co-axial rotor comprising a plurality of wings which attack the grist in a wedging action as it is pushed ahead of the leading faces of the wings and which induce in the grist internal frictional shear forces while it is forced through a gap defined between the leading edges of the wings and a series of shear means arranged axially along the interior surface of the stationary drum. The process is controlled by coordinating the angle of attack on the grist by the wings and corresponding variations in the gap clearance with the energy demands or mechanical power input.

5 Claims, 6 Drawing Figures

APPARATUS FOR CONTROLLING THE REFINING OF FIBROUS PULP GRIST IN A DRUM REFINER

FIELD OF THE INVENTION

The invention relates to a refining apparatus, particularly for refining pulp material derived from vegetable lignocellulosic substance for the production of paper products and the like. The starting material is, in the case of wood, reduced to a mass of chips before being subjected to one or more treatments to form a raw material or unrefined pulp which is not yet in suitable condition for the production of paper. This raw material comprises a mixture of wood fibers and/or other vegetable fibers and water, and is generally referred to as grist.

BACKGROUND OF THE INVENTION

In refiners of the drum type, to which this invention relates, the paste-like grist to be refined between the working surfaces of the drum and the wings is propelled in wave-like fashion in rapid pulsation succession while being subjected to a wedging action as it is accelerated by the centrifugal force exerted by the wings, which normally rotate at a linear speed ranging between 15 and 100 meters per second along the interior surface of the drum. These wings exert a force in a linear direction on the grist as it is pushed along by the leading wind edges, which force might be on the order of 5 Kg. to 10 Kg. per square centimeter, causing the grist to become compacted into wedge-shaped clumps of such a density that friction forces are induced within the grist clumps. The induced forces rise to such intensity that a plane of shear is created a short distance from the leading edge of the wings so that the wedge-shaped fiber bundles are not only broken up, but the primary layer of tracheide is substantially rubbed off, leaving the secondary layer exposed, with consequent improved fiber-to-fiber adhesion by the hydrogen bonds in the finished paper. Heretofore, this breaking up of the fiber bundles and the subsequent fibrillation of the fibers has been carried out at a fixed distance between the terminal edges of the wings and the shear members without any substantial direct contact between the individual fibers and the metallic shearing surfaces.

It should be understood that the fibers have a diameter of only some hundredths of a millimeter. Therefore, in disc refiners, or disc grinders, the spacing between the grinding elements must be extremely narrow, such as some tenths of a millimeter, so that these hair-like fibers can be firmly gripped between the grinding surfaces, with consequent risk of increased wear of and damage to the grinding elements. This risk is substantially avoided by the drum type refiner, to which the present invention relates, in which the gap between edges of the wings and the shear members may range between one mm. and two mm., while still producing a satisfactory shearing action and fibrillation of the fibers.

THE PRIOR ART

A drum refiner, of which this invention is an improvement, is disclosed in my U.S. Pat. No. 3,547,356 dated Dec. 15, 1970. Reference to this patent should be made for a more detailed explanation of the fundamental aspects associated with a drum type refiner. However, in my earlier patent, the gap between the blades and the undulations on the interior surface of the drum was designed to remain at a fixed distance during the refining action, with the idea that the gap clearance could be adjusted simply by changing rotors of different wing lengths to compensate for different rates of feed, grist concentration, motor speed and other variables associated with the refining process.

Reference is also made to my co-pending application Ser. No. 887,537 filed Mar. 17, 1978 now U.S. Pat. No. 4,199,114 dated Apr. 22, 1980, of which this application is an improvement. In my co-pending application, the blades or impellers are detachably and adjustably anchored in slots in the peripheral wall of the drum to vary the gap clearance.

The necessity for providing adjustment of the width of the gap between the grinding surfaces in disc refiners has been recognized, as indicated by U.S. Pat. Nos. 4,073,442, 3,717,308, and 3,212,721. However, as explained herein, the gap clearance is only about one-tenth of a millimeter or even less, in disc refiners, and the problem of angle of attack and resultant wedging on the grist is absent.

In the conventional hollander beaters and Jordan mills, the necessity for adjusting the gap between the roll and the bed plate has also been recognized. However, in these beaters, the grist suspension is passed between the bars of the rotating beater roll and the bars of the beater bed plate. The bar interdistance can be closely adjusted according to the amount of beating desired, which is predominantly a bruising or cutting action, in contrast to the shearing action produced by the internal frictional forces induced by the angle of attack on the grist as it is squeezed through the gap in the drum refiner. Thus, the refining action in a drum refiner may be termed a squeezing action, as compared with the grinding action in a disc refiner.

It should be understood that there are distinct differences in function and result between the grinding action in a disc refiner or the beating action in a hollander or Jordan mill, and the shear action in a drum refiner. All three types of refiners are used in the pulp and paper industry, and their application and use are related to the type of pulping process and the ultimate product which is desired.

SUMMARY OF THE INVENTION

The present invention contemplates an apparatus for controlling the refining process in a drum refiner as exemplified by my earlier U.S. Pat. No. 3,547,356 by coordinating the angle of attack by the wings on the grist and the corresponding gap clearance with the energy demands which may vary in response to the several variables associated with the refining process. It should be understood that, when the gap clearance is changed, the angle of attack by the wings on the grist must also be changed in order to produce the degree of wedging action which is required to induce in the grist the internal shear forces necessary for breaking up the fiber bundles and unravelling the fiber walls. Thus, proper adjustment of the angle between the wing and the tangent to the point of contact is important. In other words, the gap clearance is coordinated with the angle of attack on the grist by the leading face of the wing to produce the desired result.

The adjustment of the gap clearance and the angle of attack can be achieved mechanically or hydraulically. In either case, the energy demand can easily be regulated by coordinating the angle of attack and the gap clearance with the several variables associated with the refining process. Thus, the heat energy generated by increased rate of feed, pulp concentration, etc., can be converted into useful mechanical energy for the power input simply by adjusting the gap clearance, which also changes the angle of attack, with consequent saving in energy consumption.

Figures 1, 2:
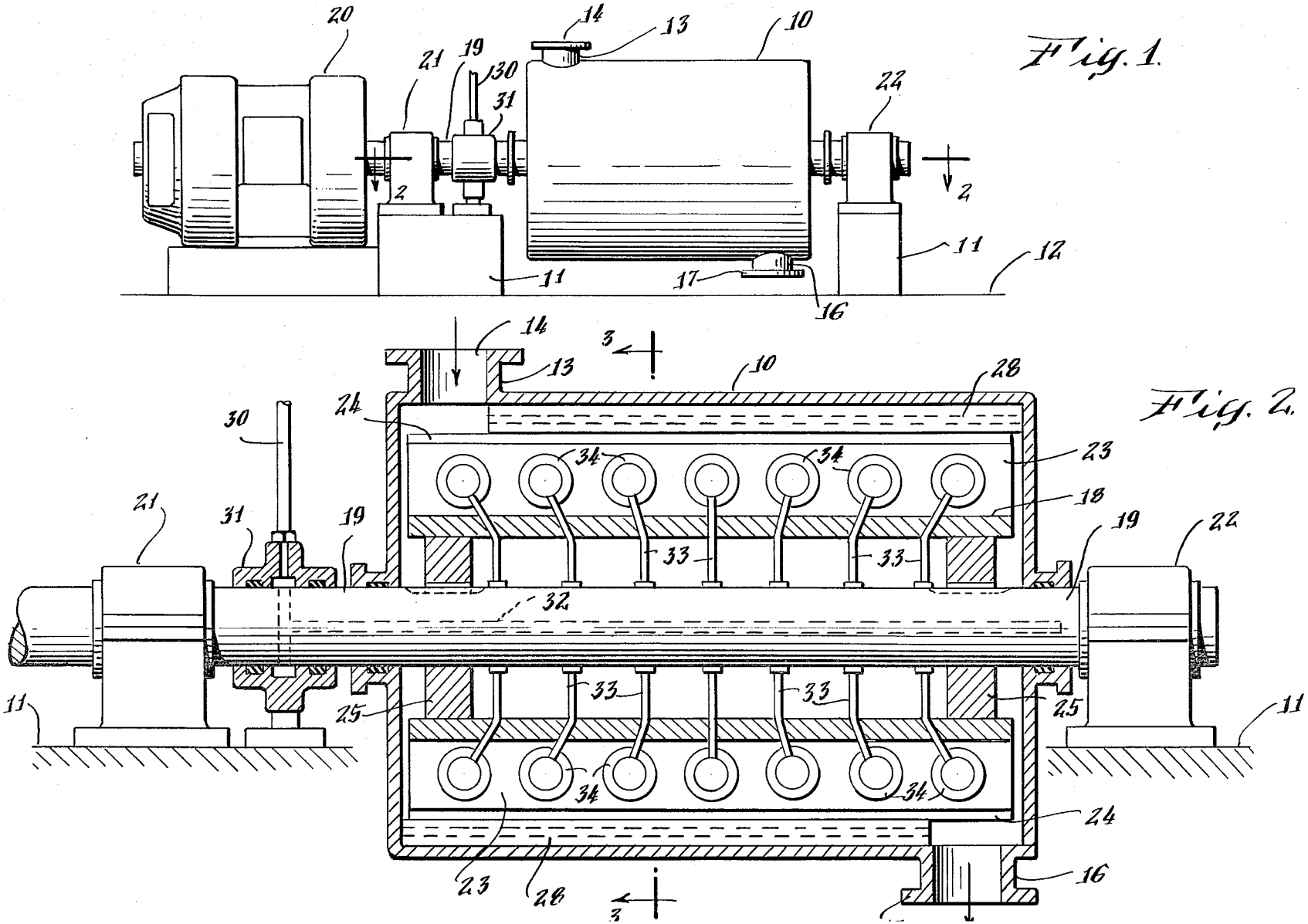
FIG. 1 is a schematic view of a drum-type refiner according to the invention.
FIG. 2 is a longitudinal section of the apparatus shown in FIG. 1, drawn to an enlarged scale.

DETAILED DESCRIPTION OF A PREFERRED EMBODIMENT OF THE INVENTION AND POSSIBLE MODIFICATION THEREOF

Referring to the drawings, the reference numeral 10 denotes a stationary cylindrical drum which is supported on a frame 11 which is anchored to a platform 12. One end of the drum is provided with an inlet collar 13 having a flange 14 for connection to a supply duct for the pulp stock or grist, which is introduced into the drum in a linear direction by means of feed screw conveyor 15.

The opposite end of the drum is provided with an outlet collar 16 having a flange 17 for connection to a discharge duct (not shown) controlled by a conventional discharge valve as disclosed, by way of example, in my U.S. Pat. No. 3,388,037.

Figure 3:
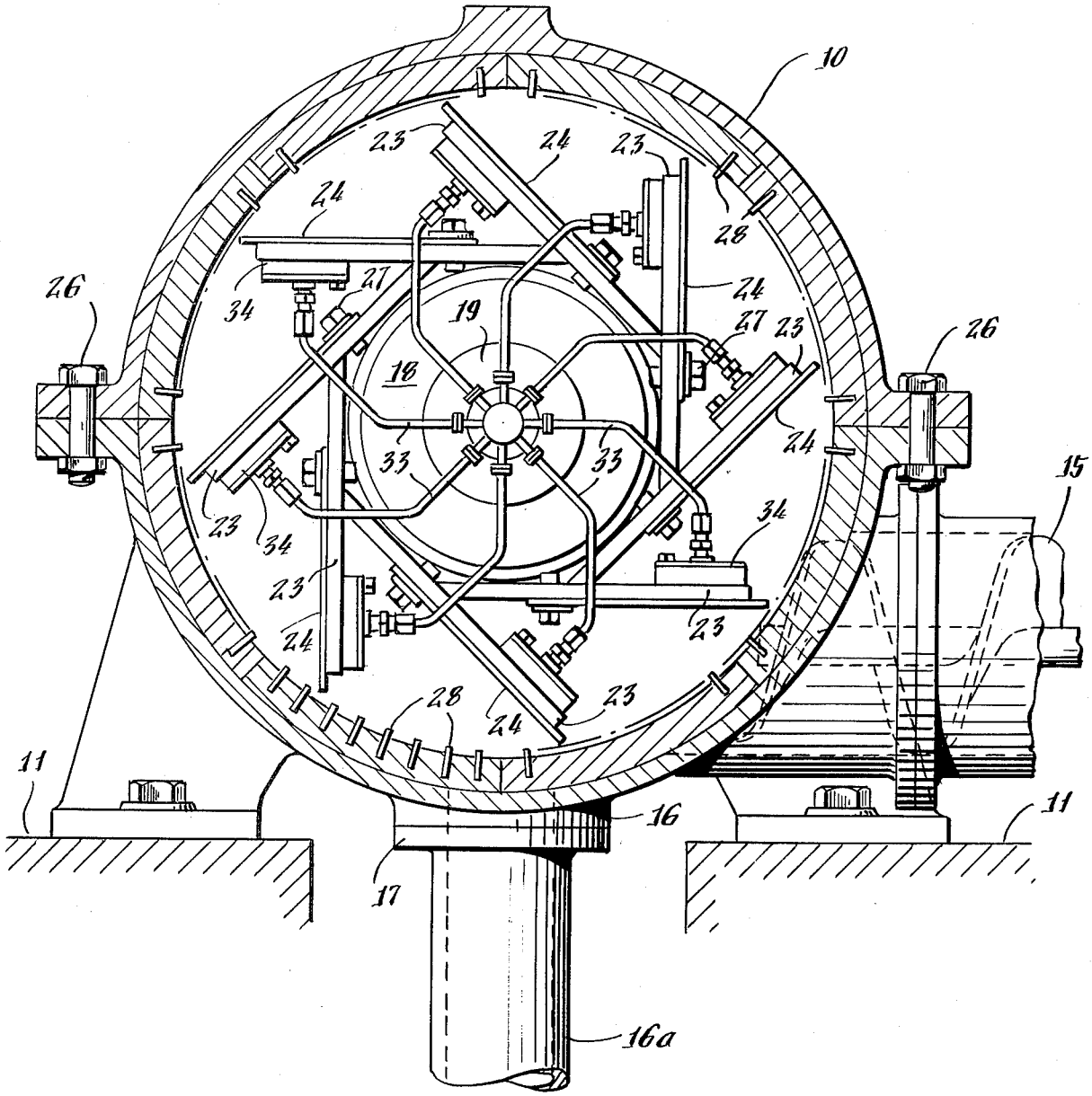
FIG. 3 is a section taken along the line 3—3 of FIG. 2, drawn to an enlarged scale.
Figure 4:
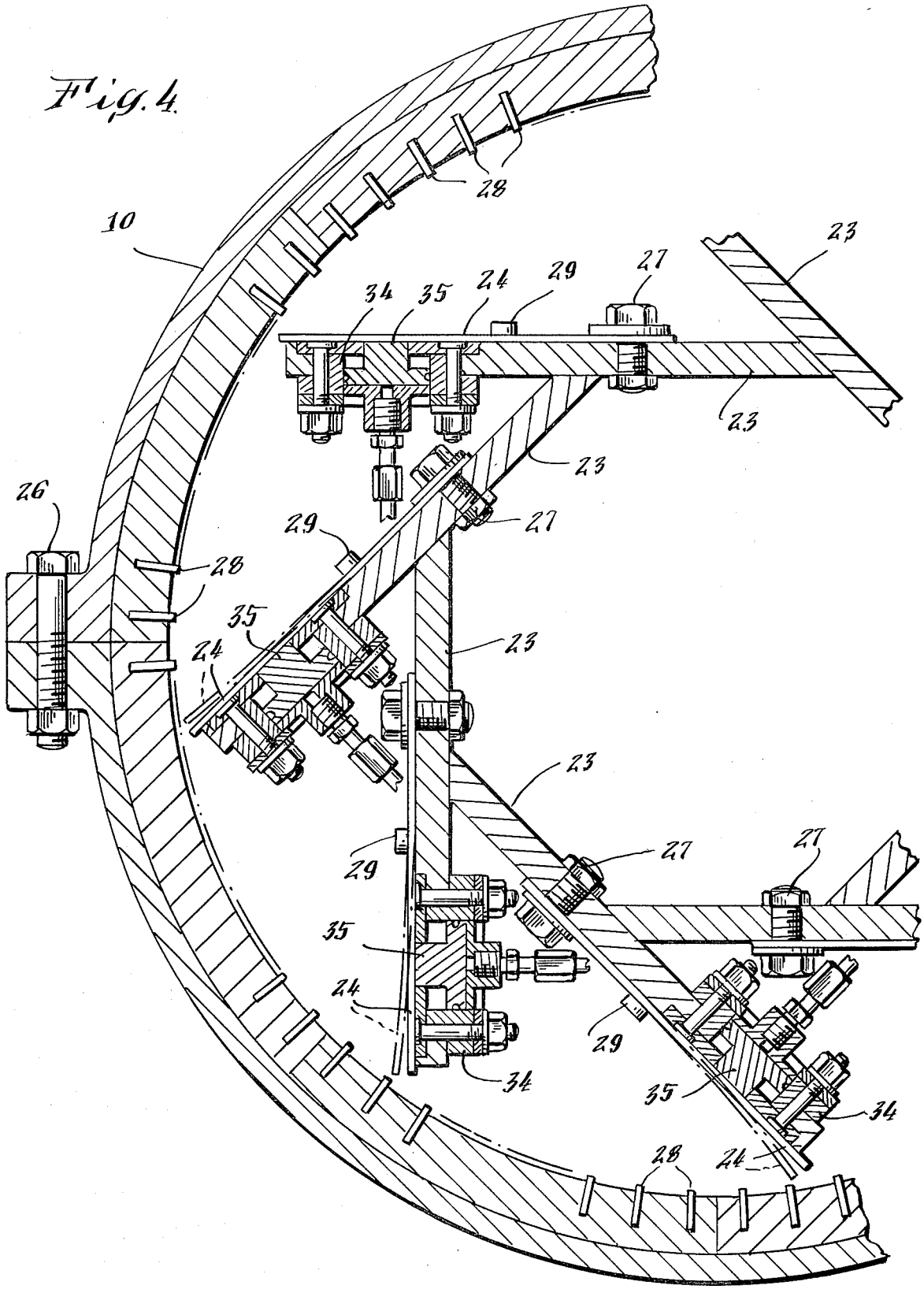
FIG. 4 is a partial detailed section of the drum and rotor shown in FIG. 3, drawn to an enlarged scale.

A rotor 18 is mounted on a shaft 19, which is driven by a motor 20. The shaft extends co-axially within the stationary drum 10 and is journalled in bearings 21 and 22. The rotor comprises a plurality of wings 23 which adjustably support blades 24 (FIG. 4). In the embodiment shown, the rotor comprises a cylindrical drum having hubs 25 at opposite ends thereof for supporting the drum on the shaft 19. It should be understood that the rotor may embody some other construction providing for rotation of the wings 23, as would be obvious to a person skilled in the art. The wings 23 are preferably straight and extend substantially tangentially from the circumference of the rotor 18, to which they may be fixed in any suitable manner. In order to ensure stability, the wings may be interconnected as shown in FIGS. 3 and 4. For the purpose of facilitating assembly and dismantling of the rotor, the stationary drum may comprise two semi-circular components which are bolted together by bolts 26. The number of wings may vary according to the capacity of the refiner. In the embodiment shown, the rotor comprises eight wings.

The blades 24 lie flat along the trailing surface of the wing when maximum gap clearance is desired. In order to allow for some flexibility of the blades in response to the centrifugal force, which will tend to flex them counter to the direction of rotation, the degree of flexure is restricted by a bolt 27 or some other stop means providing sufficient play between the wing and the blade, while still substantially maintaining the predetermined angle of attack.

Shear means 28 are arranged about the interior surface of the stationary drum 10 along the length thereof, which means, together with the terminal edges of the blades 24, define the shear gap. These shear means meet and momentarily exert a braking effect on the grist as it is advanced in a linear direction through the stationary drum 10.

As disclosed in my co-pending Application Ser. No. 887,537, the shear means 28 are made of highly wear-resistant material, such as silicon, carbide or carborundum, and are machined into the interior peripheral wall of the drum. These shear means cover substantially the entire inside wall of the drum and project therefrom a distance ranging between 1 mm. and 2 mm., in order to define strong lines of shear within the moving grist.

The grist is introduced through the inlet 14 and conveyed into the feed screw 15 (FIG. 3). The grist is pushed ahead of the blades 24 and is accelerated by the latter to a high peripheral speed against the gap. Thus, the grist particles become increasingly and intensely compacted by the centrifugal force as they are flung outwardly by the blades, as disclosed in my U.S. Pat. No. 3,547,356. The aforesaid patent suggests the addition of water or some other cooling means, to compensate for the high temperature increase produced by the frictional energy exerted on the grist during its pulsating progression through the apparatus. This implies some waste of energy. It should be understood that, at the time when I made my earlier invention, about 1967, saving of energy for refining purposes was not a paramount problem as it is today.

The present invention purports to preserve costly mechanical energy by adjusting the angle of attack on the grist and corresponding variations in the gap clearance in response to variations in the generation of energy during the refining process.

This object can be achieved by deflecting the blades from the supporting wings at an angle thereto which corresponds to the desired angle of attack and gap clearance.

The adjustment can be made manually by means of bolts 27, which also serve to connect the blades to the wings, but can also be made hydraulically by providing the shaft 19 with ducts for the hydraulic fluid which is pumped into hydraulic cylinders installed in the wings, as shown by way of example, in the drawings.

Figure 5:
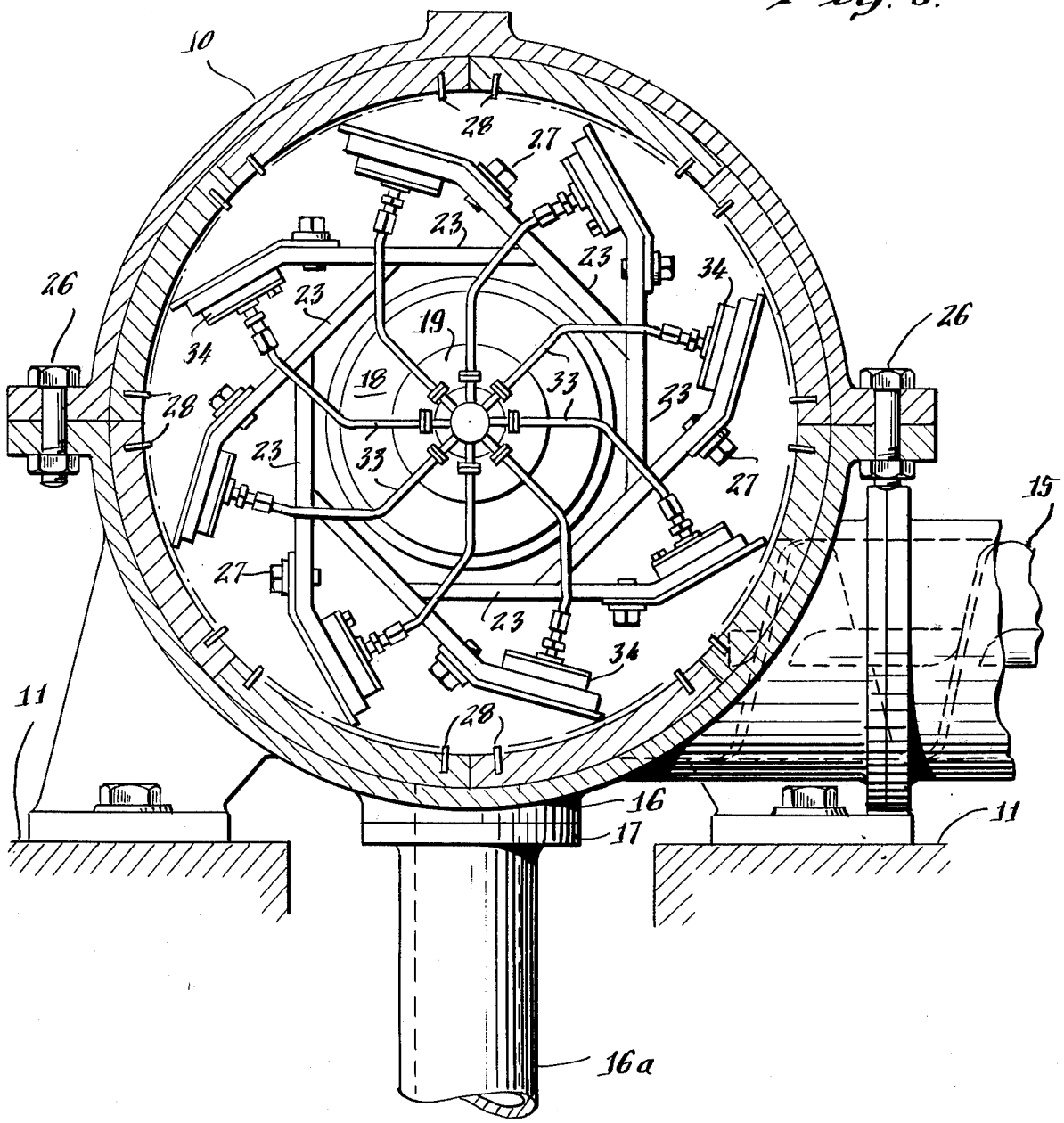
FIG. 5 is a view similar to FIG. 3 of a modification thereof.

An additional method of varying the angle of attack and the wedging action is shown, by way of example, in FIG. 5.

Provision may also be made for supplying hydraulic fluid at different pressures along the linear route of the grist in response to localized conditions in the refiner. Such an example is shown in FIG. 6.

As shown in FIGS. 1 and 2, hydraulic fluid is pumped through the supply duct 30 into the ducted swivel 31 on the shaft 19. The ducts in the swivel communicate with the duct 32 in the shaft 19. The hydraulic fluid is distributed through the ducts 33 to conventional hydraulic cylinders 34, which are spaced longitudinally along the wings 23 to actuate the hydraulic pistons 35 therein. The hydraulic pistons 35 project through an aperture in the wings 23 to abut the blade 24. By regulating the flow of hydraulic fluid to the cylinders, the blades 24 can be deflected along a path substantially tangential to the point of contact with the grist between the terminal edges of the wings 23 and adjacent the shear means 28, to thereby vary their angle of attack between a maximum gap clearance, i.e., when the blade lies substantially flat with slight play against the surface of the wing, and a predetermined minimum gap clearance, which might be said to represent the stall angle of the wing. For practical purposes, the gap clearance may be varied between 7 millimeters and 1 millimeter, with corresponding variations in the angle of attack in response to the energy demand or power input.

As shown in FIG. 5, the angle of attack may additionally be varied by angulating the outer end of the wing 23 which carries the hydraulic cylinders 34, to produce the desired wedging action. This arrangement provides for greater flexibility in selection of rotor dimension.

Figure 6:
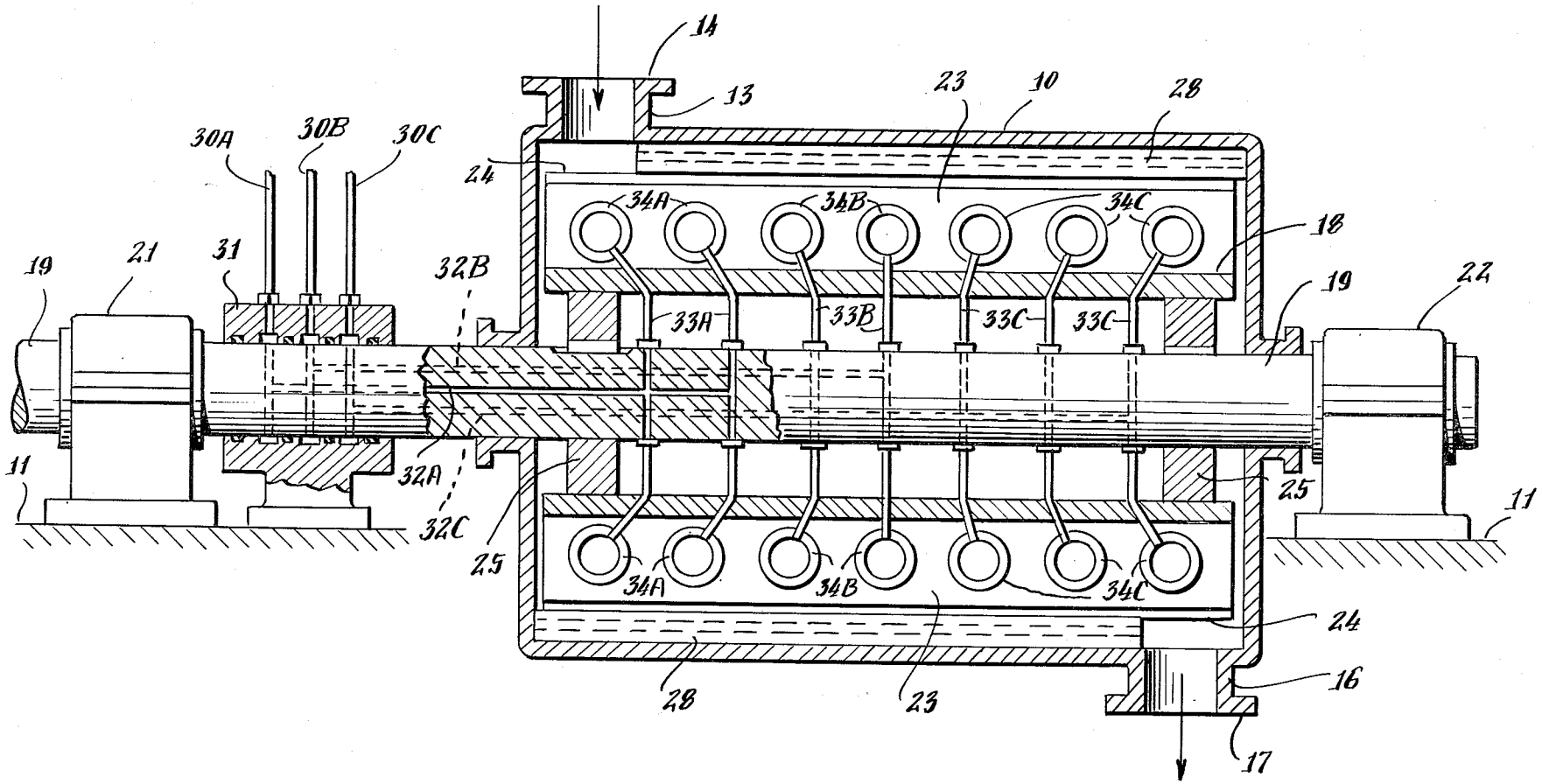
FIG. 6 is a view similar to FIG. 2, of a further modification.

In the modification shown in FIG. 6, the rotor is subdivided into three sections, A, B and C, each section being supplied with hydraulic fluid at three different pressures. This requires three separate ducts, A, B and C, in the swivel 31, each communicating with corresponding ducts in the shaft 19. It should be understood, however, that the rotor may be subdivided into as many sections as may be found practical for the particular installation.

It should be clear that this arrangement provides for adjustments of the gap clearance and the angle of attack at several locations along the linear route of the grist through the drum refiner. During the refining process, disturbances in the rate of flow of grist may develop, which should be promptly adjusted, in order to save energy consumption. For instance, if some unforseen clogging should occur along the linear route of the grist, the clogged portion of the route may be promptly cleared simply by increasing the gap clearance. Conversely, if the rate of flow should increase unduly along a section of the route, the clearance may be automatically adjusted. For, example, if the rate of feed of pulp material should increase beyond a programmed rate without commensurate increase in refiner or motor load, the temperature will drop, with consequent decrease in energy input per unit of weight. On the other hand, if the feed of grist should be interrupted entirely, for instance, by plugging of the refiner, along a section of the linear route, the arrangement shown in FIG. 6 immediately provides for increased gap clearance with possible additional water supply to flush out the plugged refiner sections.

In this manner, the angle of attack and the corresponding gap clearance may be coordinated with the heat quotients of the mechanical energy input in accordance with a programmed refining process, as shown, for instance, by U.S. Pat. Nos. 3,717,308, 3,212,721 and 4,073,442. While these patents relate to the adjustment of the disc clearance by hydraulic means in disc refiners, it should be obvious to a person skilled in the art to utilize similar means for regulating the flow of hydraulic fluid to the hydraulic cylinder on the wings 23 to thereby adjust the gap clearance and corresponding angle of attack in accordance with the programmed process.

Another system for regulating the mechanical energy in a disc refiner is disclosed in U.S. Pat. No. 4,148,439, which system may also be easily modified for application to the present invention.

It should be understood that the description herein is given by way of example and not by way of limitation. The invention may find a variety of expressions within the scope of the accompanying claims.

I claim:

1. In a drum refiner for refining pulp stock, in which the pulp grist is conveyed into a stationary cylindrical drum and propelled in a linear direction therein by a co-axial rotor comprising a plurality of wings having a leading face and a trailing face which attack the grist at an angle in a wedging action as its is pushed ahead by the leading face of the wing in a pulsating fashion to induce in the grist internal frictional shear forces while being squeezed through a gap clearance defined between the free end of the wings and shear means arranged axially along the interior cylindrical wall surface of the stationary drum, the improvement comprising:

blade means mounted adjustably along a surface of said wings so as to be deflected at an angle thereto and effective simultaneously to coordinate the angle of attack on the grist and the gap clearance variations in energy demand during the refining process.

2. A drum refiner according to claim 1, in which blade means are mounted on said wings so as to permit the free ends thereof to be deflected at an angle to the wings.

3. A drum refiner according to claim 1, in which the blade means are deflected by hydraulic means carried by the wings and controlled in response to variations in energy demands during the refining process.

4. A drum refiner according to claim 3, in which the rotor comprises a plurality of wing-equipped sections, each section being separately controlled by the hydraulic means in response to localized variations in energy demands along the linear route of the grist through the drum.

5. A drum refiner according to claim 1, in which the wings comprise an inner portion and an outer portion which extends at an angle to said inner portion and which outer portion supports said blade means.

* * * * *